United States Patent [19]

Miura

[11] 4,328,668

[45] May 11, 1982

[54] SECONDARY AIR SUPPLY SYSTEM FOR INTERNAL COMBUSTION ENGINES

[75] Inventor: Motohisa Miura, Toyota, Japan

[73] Assignee: Nippondenso Co., Ltd., Kariya, Japan

[21] Appl. No.: 185,724

[22] Filed: Sep. 11, 1980

Related U.S. Application Data

[63] Continuation of Ser. No. 913,737, Jun. 6, 1978, abandoned.

[30] Foreign Application Priority Data

Jun. 28, 1977 [JP] Japan ..... 52/84919[U]

[51] Int. Cl.[3] ..... F01N 3/22

[52] U.S. Cl. ..... 60/290

[58] Field of Search ..... 60/289, 290

[56] References Cited

U.S. PATENT DOCUMENTS 3,751,916 8/1973 Hayashida ..... 60/290

3,906,723 9/1975 Matumoto ..... 60/290

4,147,032 4/1979 Suzuki ..... 60/290

FOREIGN PATENT DOCUMENTS 2235596 2/1973 Fed. Rep. of Germany ..... 60/290

11323 1/1977 Japan ..... 60/290

*Primary Examiner*—Douglas Hart

*Attorney, Agent, or Firm*—Cushman, Darby & Cushman

[57] ABSTRACT

A control valve is mounted on an air relief line branched off from a secondary air supply line extending from an air pump to an exhaust pipe for controlling the pressure of air in the secondary air supply line. The control valve so controls the pressure of the air in the air supply line as to increase it when acceleration of an engine starts or to decrease it when deceleration of the engine starts, whereby the amount of the secondary air supplied to the exhaust pipe is controlled in response to the acceleration and deceleration of the engine.

5 Claims, 3 Drawing Figures

SECONDARY AIR SUPPLY SYSTEM FOR INTERNAL COMBUSTION ENGINES

This is a continuation of application Ser. No. 913,737, filed June 6, 1978, now abandoned.

BACKGROUND OF THE INVENTION

The present invention relates to a secondary air supply system for an internal combustion engine, which is used to oxidize unburnt exhaust gas components emitted from the engine. More particularly, the invention relates to a control valve capable of not only supplying required amount of secondary air to an exhaust pipe so as to oxidize the unburnt exhaust gas components emitted from the engine during normal steady running and acceleration operations of the engine but also releasing almost all of air from an air pump driven by the engine to the atmosphere during deceleration operation of the engine so as to prevent afterburning phenomena.

In a conventional secondary air supply system for an engine, there have been provided individually two kinds of separate control valves, one of which is an air bypass valve (or an anti-after-buring valve) for bypassing or releasing almost all of air from an air pump to the atmosphere for several seconds during engine deceleration so as to prevent afterburning phenomena and the other of which is a relief valve for maintaining the pressure of air from the air pump below a predetermined value so as to ensure a long life-time of the air pump.

The conventional system just described, however, during operations where a large amount of secondary air is required, such as acceleration operation, runs short of secondary air to be supplied to the exhaust pipe since a large amount of air from the air pump is discharged into the atmosphere through the relief valve in spite of the fact that the air pump is pumping out the sufficient amount of the secondary air.

A modification has been also proposed in which the relief valve is constructed within the air bypass valve, however it is disadvantageous in that the modification is high in cost and complicate the construction because the valve bodies of the relief valve and air bypass valve are still separately made in such a way that those valve bodies operate independently.

SUMMARY OF THE INVENTION

It is, therefore, an object of the present invention to provide a secondary air control valve which is mounted on an air relief line branched off from a secondary air supply line for not only increasing the amount of secondary air at the beginning of acceleration of an engine so as to sufficiently oxidize unburnt exhaust gas components, but also decreasing the amount of the secondary air or shutting off the supply of the secondary air at the beginning of deceleration so as to prevent after-burning of the exhaust gas.

DETAILED DESCRIPTION OF THE PREFERRED EMBODIMENTS

Figure 1:
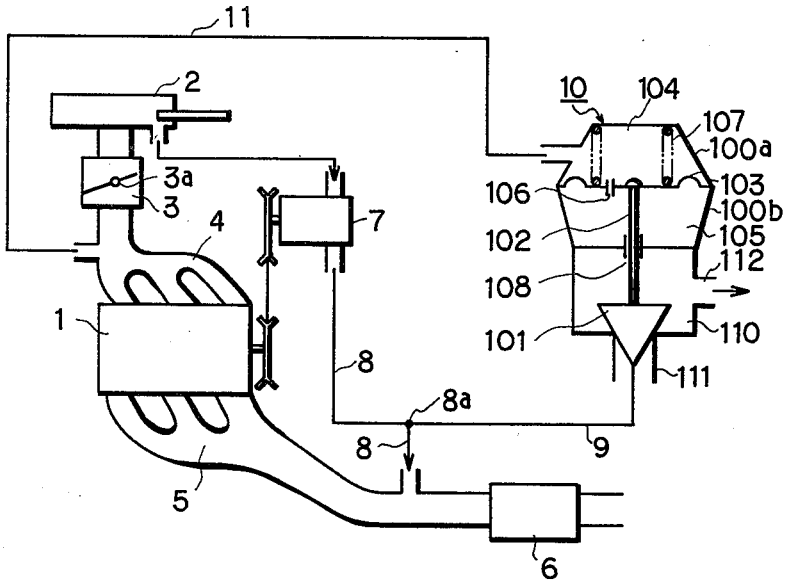
FIG. 1 is a schematic diagram showing a principal part of the invention.

In FIG. 1 showing a first embodiment of the invention, numeral 1 designates an internal combustion engine to which an intake manifold 4 is connected for supplying an air-fuel mixture to the engine 1. An intake system of the engine generally has an air cleaner 2 and a carburetor 3 with a throttle valve 3*a* connected to the intake manifold 4. An exhaust system of the engine has an exhaust pipe 5 for conveying the exhaust gases from the engine to the atmosphere and a catalytic converter 6 for purifying the exhaust gases.

A secondary air supply system of the invention comprises an air pump 7 driven by engine 1 through a belt for pumping out air under a high pressure. A secondary air supply line 8 extends from the air cleaner 2 through the input side and output side of the air pump 7 to the exhaust pipe 5 at the upstream side of the catalytic converter 6 for supplying the air from the air pump 7 to the exhaust pipe as a secondary air so that the unburnt component such as unburnt hydrocarbon (HC), carbon monoxide (CO) etc. contained in the exhaust gas emitted from the engine are oxidized. An air relief line 9 is branched off from the secondary air supply line 8 at a branch point 8*a* for discharging the air therefrom into the atmosphere when the line 9 is opened.

Although not shown in the drawing, a check valve can be disposed in the secondary air supply line 8 downstream of the branch point 8*a* for preventing the back flow of the exhaust gases.

For the purpose of opening or closing the air relief line 9, there is provided therein a control valve 10 which comprises upper and lower housing parts 100*a* and 100*b;* a deformable diaphragm 103 interposed between the upper and lower housing parts for defining therein first and second pressure chambers 104 and 105 above and below the diaphragm 103; a compression coil spring 107 disposed in the first pressure chamber 104 for urging the diaphragm 103 towards the second pressure chamber 105; and a small aperture 106 formed on the diaphragm 103 for intercommunicating the first and second pressure chambers 104 and 105 with each other. The first pressure chamber 104 of the valve 10 is communicated to the intake manifold 4 through a pressure line 11 so that the intake vacuum in the intake manifold is applied thereto. Because of the provision of the aperture 106 on the diaphragm 103, the pressure in the second pressure chamber 105 is equal to that in the first pressure chamber 104 when the engine is running at the normal stable conditions.

The lower housing part 100*b* includes a compartment 110 below the second pressure chamber 105, an inlet (relief) port 111 connected to the air relief line 9, and an outlet port 112 opening to the atmosphere.

A valve body 101 of a conical configuration is disposed in the compartment 110 and is connected with the diaphragm 103 by a rod 102, which extends air-tightly through a bushing 108 disposed on a wall between the second chamber 105 and the compartment 110, so that it may open or close the inlet port 111 in cooperation with the upper edge of the inlet port 111.

An operation of the first embodiment as just described will be explained.

During a normal stable running of the engine, that is a running condition where the throttle valve 3*a* is generally held at a constant opening level, no violent variation exists in the intake vacuum, so that the pressure in the second chamber 105 becomes equal to that in the first chamber 104 because of the aperture 106. With this condition, the diaphragm 103 is moved downwardly by the urging force of the spring 107 to close the inlet port 111 by the valve head 101.

The pressure of the air in the secondary air supply line 8, especially in the air relief line 9 works on the undersurface of the valve head 101 to urge the same in a direction opposite to the urging force of the spring 107. When the upward urging force working on the valve head 101 becomes higher than the downward urging force of the spring 107, the valve head 101 is lifted to open the inlet (relief) port 111, that is the air relief line 9, so that a portion of the air from the air pump 7 is permitted to flow through the compartment 110 and the outlet port 112 into the atmosphere. As above the control valve 10 maintains the pressure of the air in the secondary air line 8 within a predetermined value.

At the beginning of an acceleration of the engine, the intake vacuum on line 11 suddenly decreases (the absolute pressure increases) in accordance with the degree of the acceleration so that at the same time the pressure in the first pressure chamber 104 of the control valve 10 also increases rapidly, while the pressure in the second pressure chamber 105 changes (increase) slowly. The pressure difference is, therefore produced across the diaphragm 103 for a predetermined period (about several to ten seconds) and it urges the diaphragm 103 downwardly in the same direction of the urging force of the spring 107. As above, since the downward urging force for the valve head 101 is increased at the beginning of acceleration the air relief pressure of the control valve 10 is also increased with the result that the amount of the secondary air supplied to the exhaust pipe 5 is increased to sufficiently oxidize the unburnt exhaust gas components.

In the above accelerations, as the degrees of the accelerations become larger, the relief pressure becomes higher and the duration of the increased relief pressure is prolonged. As time passes after acceleration, the pressure difference across the diaphragm 103 between the first and second chambers 104 and 105 gradually decreases by means of the aperture 106. So when the predetermined period has passed, the pressure difference across the diaphragm 103 becomes zero so that the relief pressure of the control valve is restored to its initial value.

On the other hand, at the beginning of deceleration of the engine the reverse operation occurs. When deceleration starts, the intake vacuum on line 11 suddenly increases (the absolute pressure decreases) in accordance with the degree of the deceleration. At the same time, the pressure in the first pressure chamber 104 of the control valve 10 decreases rapidly while the pressure in the second pressure chamber 105 changes (decreases) slowly. The pressure difference is, therefore produced across the diaphragm 103 for a predetermined period and it urges the diaphragm 103 upwardly in the opposite direction of the urging force of the spring 107. Since the air relief pressure is decreased in accordance with the degrees of the decelerations, the valve head 101 is lifted to open the inlet port 111 when the degree of the deceleration exceeds a predetermined level and the amount of the lift as well as the time duration of lifting the valve head is responding to the degrees of the decelerations.

As above, the opening degree of the air relief line 9 by the control valve 10 is controlled at the beginning of the decelerations, and thereby the amount of the secondary air supplied to the exhaust pipe 5 is decreased.

It is also possible in the above embodiment to shut off the supply of secondary air when a small orifice is provided in the secondary air supply line 8 downstream of the branch point 8*a* since almost all of the secondary air is released into the atmosphere when the air relief line 9 is opened.

Figure 2:
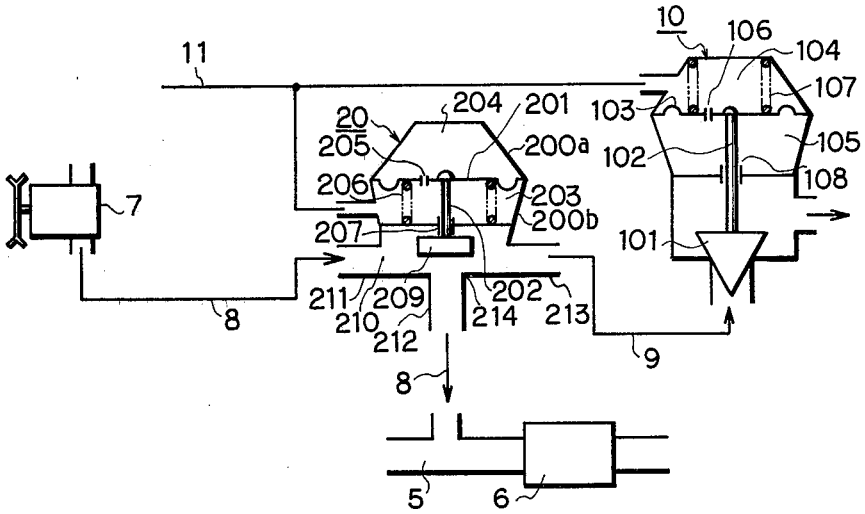
FIGS. 2 and 3 are schematic diagrams showing modifications of the invention.

Referring to FIG. 2, a second embodiment will be explained. An air switching valve 20 is provided at the branch point 8*a* in the first embodiment. The valve 20 comprises first and second casings 200*a* and 200*b*, a diaphragm 201 interposed therebetween to define first and second pressure compartments 203 and 204, an orifice 205 formed on the diaphragm 201 for the pneumatic communication between the first and second pressure compartments 203 and 204, and a compression coil spring 206 disposed in the first pressure compartment 203 for urging the diaphragm 201 upwardly towards the second pressure compartment 204. The first pressure compartment 203 is communicated to the intake manifold 4 through the pressure line 11 so that the intake vacuum is always supplied thereto. As in the control valve 10, the pressure in the first pressure compartment 203 is equal to that in the second pressure compartment 204 through the orifice 205 when the engine is running at the normal stable conditions.

The second casing 200*b* includes a valve compartment 210 below the first compartment 203 and first to third ports 211 to 213 which are respectively connected to the air pump 7 through the secondary air line 8, to the exhaust pipe 5 through the line 8 and to the control valve 10 through the air relief line 9. A poppet type valve body 209 is disposed in the valve compartment 210 and is connected to the diaphragm 201 by a rod 202, which extends air-tightly through a bushing 207 disposed on a wall between the pressure compartment 203 and the valve compartment 210, so that it may open or close the second port 212 in cooperation with the upper edge 214 (acting as a valve seat) of the port 212. And other constructions of this embodiment are the same to that of the first embodiment.

An operation of the second embodiment especially an operation of the air switching valve 20 will be explained.

During the stable running or accelerations of the engine, the valve body 209 is lifted at its uppermost position by the urging force of the spring 206 and further in the case of accelerations by the pressure difference acting on the diaphragm 201 in an upward direction, so that the second port 212 is opened. With this condition, the second embodiment operates in the same manner as that of the first embodiment.

On the contrary, when the deceleration starts, the pressure difference is also produced on the diaphragm 201 in a downward direction to urge the valve body 209 towards the upper edge 214 of the second port 212. When the degree of the deceleration exceeds a predetermined level the valve body 209 is seated on the edge 214 to close the second port 212 so that the supply of the secondary air is completely shut off to prevent afterburning phenomena.

Figure 3:
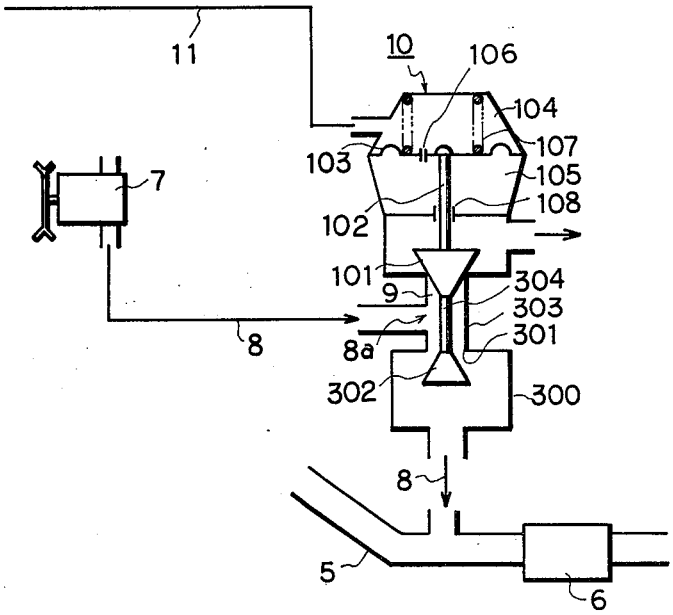

FIG. 3 shows a third embodiment of the invention, wherein modification of the first embodiment is shown. A valve compartment 300 is formed on the secondary air supply line 8 between the branch point 8*a* and the exhaust pipe 5. Disposed in the valve compartment 300 is a second valve head 302 of a conical configuration connected to the (first) valve head 101 through a link device 304 such as a rod in the drawing. The second valve head 302 is moved back and forth in accordance with the movement of the (first) valve head 101 so as to open and close the secondary air supply line in cooperation with a valve seat 301 formed at the inlet port 303 of the compartment 300. When the deceleration of the engine starts, the valve head 101 is lifted as explained in the first embodiment and at the same time the second valve head 302 is lifted to close the inlet port 303 of the compartment, so that the supply of the secondary air is shut off as in the second embodiment. The operations of the third embodiment during the stable running and accelerations of the engine are the same as that of the first embodiment.

What is claimed is:

1. A secondary air supply system for an internal combustion engine comprising:

an air pump driven by an engine for pumping pressurized air;

a secondary air supply line connecting said air pump with an exhaust pipe of said engine for supplying air to said exhaust pipe to oxidize unburnt exhaust gas components therein; and control means in said secondary air supply line for controlling the amount of air released into said exhaust pipe and the atmosphere from said secondary air supply line, to thereby correctly control the oxidation of unburnt gases emitted by an engine, said control means including:

first valve means for entirely closing the secondary air supply line to the exhaust pipe under deceleration conditions; and second valve means operatively connected to said first valve means for providing increased pressure for a predetermined period within said secondary air supply line under acceleration conditions of the engine and pressure release thereafter under high pressure conditions, said first and second valve means including first and second valve members, respectively, and first and second means for respectively operating said first and second valve members in response to intake manifold pressures, said second valve member having an undersurface acted on by air pressure within the secondary air supply line so that pressure therein can urge said second valve member in a direction opposite to that applied by said second operating means.

2. A secondary air supply system as in claim 1 wherein said first valve means is located at the connection formed in said secondary air supply line leading to said exhaust pipe, and said second valve means is located downstream therefrom.

3. A secondary air supply system as in claim 1, wherein the operating means of said first valve means includes:

upper and lower casings;

a diaphragm interposed between said upper and lower casings for defining therein first and second pressure compartments, said first pressure compartment being connected to said intake manifold so that the pressure therein is introduced into said first pressure compartment;

a spring for biasing said diaphragm towards said second pressure compartment;

an orifice formed on said diaphragm for communicating said first pressure compartment with said second pressure compartment;

a valve compartment formed on a side of said first pressure compartment and having first, second and third ports therein, said first, second and third ports being respectively connected to said air pump, said exhaust pipe and to said second valve means; and said first valve member being disposed in said valve compartment, and connected to and driven by said diaphragm for opening and closing said second port in accordance with the movement of said diaphragm, so that rapid pressure decreases in said intake manifold at the beginning of deceleration produces a pressure difference across said diaphragm driving the same to close said second port by said first valve member.

4. A secondary air supply system as in claims 1 or 3 wherein the operating means of said second valve means includes:

upper and lower housing parts;

a diaphragm interposed between said upper and lower housing parts for defining therein first and second pressure chambers, said first pressure chamber being connected to an intake manifold of said engine so that the pressure in said intake manifold is introduced into said first pressure chamber;

a spring for biasing said diaphragm towards said second pressure chamber;

an aperture formed in said diaphragm for communicating said first pressure chamber with said second pressure chamber and controlling the predetermined biasing periods between said first and second chambers; and a relief port open to the atmosphere disposed in said secondary air supply line;

said second valve member being connected to and driven by said diaphragm for opening and closing said relief port in accordance with the movement of said diaphragm, whereby a rapid pressure increase in said intake manifold at the beginning of the acceleration of said engine produces a pressure difference across said diaphragm for a predetermined period of time biasing said diaphragm to apply additional pressure on said second valve member to close said relief port whereby the pressure of the air in said secondary air supply line is increased, while a rapid pressure decrease in said intake manifold at the beginning of the deceleration of said engine produces a pressure difference across said diaphragm for a predetermined period of time biasing said diaphragm to raise said second valve member to open said relief port whereby the pressure of the air in said secondary air supply line is decreased so that a substantial amount of air is released into the atmosphere through said relief port valve.

5. A secondary air supply system for an internal combustion engine comprising:

an air pump driven by said engine for pumping pressurized air;

a secondary air supply line connecting said air pump with an exhaust pipe of said engine for supplying the air from said air pump to said exhaust pipe so as to oxidize unburnt exhaust gas components;

an air relief line branched off from said secondary air supply line; and control valve means connected to said air relief line for controlling the amount of the air released into the atmosphere from said secondary air supply line under deceleration conditions, for controlling the pressure of the air in said secondary air supply line during normal cruise conditions and for raising relief line pressure for a predetermined period of time under acceleration conditions, said control valve means including:

first valve means for entirely closing the secondary air supply line from the exhaust pipe under deceleration conditions; and second valve means operatively connected to said first valve means for increasing relief pressure for a predetermined period of time under acceleration conditions and thereafter providing pressure control within said secondary air supply line under cruise conditions of the engine and pressure release in said relief line under deceleration conditions, said first and second valve means, including first and second valve members, respectively, and first and second means for operating said first and second valve members in response to intake manifold pressures, said second valve member having an undersurface acted on by air pressure in said air relief line so that pressure therein can urge said second valve member in a direction opposite to that applied by said second operating means.

* * * * *